US005545342A

United States Patent [19]

Beagle et al.

[11] Patent Number: 5,545,342

[45] Date of Patent: Aug. 13, 1996

[54] ANTISTATIC COMPOSITIONS AND ANTISTATIC DETERGENT COMPOSITIONS AND ARTICLES

[75] Inventors: Charles A. Beagle, South Plainfield; Richard P. Adams, Monmouth Jct.; Harold E. Wixon, New Brunswick, all of N.J.

[73] Assignee: Colgate-Palmolive Co., New York, N.Y.

[21] Appl. No.: 361,028

[22] Filed: Dec. 21, 1994

Related U.S. Application Data

[63] Continuation of Ser. No. 83,416, Jun. 28, 1993, abandoned, which is a continuation of Ser. No. 792,314, Nov. 14, 1991, abandoned, which is a continuation of Ser. No. 644,728, Jan. 23, 1991, abandoned, which is a continuation of Ser. No. 346,053, May 2, 1989, abandoned.

[51] Int. Cl.[6] ..... C11D 3/37; C11D 1/83

[52] U.S. Cl. ..... 510/299; 510/466; 510/475; 510/517; 510/297; 510/331; 510/327; 510/439

[58] Field of Search ..... 252/174.15, 89.1, 252/174.23, DIG. 16, 8.6, 8.8, 8.9

[56] References Cited

U.S. PATENT DOCUMENTS

| | | | |
|---|---|---|---|
| 4,105,567 | 8/1978 | Koerner et al. | 252/8.6 |
| 4,562,772 | 2/1986 | Ciallella | 252/8.6 |
| 4,579,964 | 4/1986 | Totten et al. | 556/434 |
| 4,624,676 | 11/1986 | White et al. | 8/115.56 |
| 4,639,321 | 1/1987 | Barrat et al. | 252/8.8 |
| 4,767,548 | 8/1988 | Kasprzak et al. | 252/8.8 |
| 4,818,421 | 4/1989 | Boris et al. | 252/8.8 |

*Primary Examiner*—Paul Lieberman
*Assistant Examiner*—Kery Fries
*Attorney, Agent, or Firm*—Bernard Lieberman; James M. Serafino

[57] ABSTRACT

Antistatic, fabric softening and soil release promoting compositions are disclosed which comprise nonionic detergent, soil release promoting agent of the PET-POET type, and a certain type of silicone polymer (designated Type X or Silicone X). Such compositions very preferably also include cationic fabric softener (CFS), polyacrylate, silicone glycol copolymer (SGC), and builder for the nonionic detergent, with adjuvants being optional.

Also within the invention are compositions that comprise only some of the mentioned components, and such compositions may be employed as wash cycle additives to improve the properties of detergent compositions and of softergent compositions. Processes for manufacturing and using the invented compositions are also disclosed.

23 Claims, 1 Drawing Sheet

ANTISTATIC COMPOSITIONS AND ANTISTATIC DETERGENT COMPOSITIONS AND ARTICLES

This is a Continuation of application Ser. No. 08/083,416 filed Jun. 28, 1993 now abandoned, which is a continuation of U.S. Ser. No. 07/792,314 filed Nov. 14, 1991 now abandoned, which is a continuation of U.S. Ser. No. 7/644,728 filed Jan. 23, 1991 now abandoned, which is a continuation of U.S. Ser. No. 7/346,053 filed May 2, 1989 now abandoned.

This invention relates to antistatic compositions. More particularly, it relates to antistatic detergent compositions, such as nonionic synthetic organic detergent compositions containing cationic fabric softeners (which are called softergents), which compositions are of improved antistatic (or static charge accumulation inhibiting) action on washed laundry. It also relates to products that include components of such softergent or detergent compositions, except for the detergent(s) and builders for them, which non-detergent compositions are useful as wash cycle antistatic and fabric softening additives to washing machine wash water or rinse water, or which may be used to produce antistatic sprays and dryer products, such as dryer sheets, which soften drying laundry and make it antistatic.

Synthetic organic detergent compositions have long been employed for washing laundry in automatic washing machines. Such compositions are normally built with inorganic builder salts to improve their detergency and physical properties. They have also included cationic fabric softening agents to overcome any perceived roughness of the surfaces of the washed laundry and to inhibit accumulations of static charges thereon, which often occur when the laundry is subsequently dried in an automatic clothes dryer. Although improved softergent compositions have been manufactured and marketed, which are effective cleaning agents and soften washed laundry, further improving of such and other properties of such softergent compositions has been the subject of extensive research, the object of which has been to make even better softergent compositions, which clean well and make the washed laundry softer and static-free or of a lesser tendency to accumulate static charges.

Among the results of such research have been discoveries of fabric softening detergent compositions and articles, such as those that have been described in U.S. patent application Ser. Nos. 07/098,345 and 07/098,347. Such patent applications relate primarily to articles composed of fabric softening detergent compositions that are preferably packaged in single use water permeable pouches or packets, which articles are useful as sources of pre-measured detergent compositions, and are of increased convenience for charging such compositions to automatic washing machines. In Ser. No. 07/098,347 and any corresponding published foreign specifications, which might be the closest prior art to the present invention, a packeted built nonionic synthetic organic softergent composition is described which contains cationic fabric softener (CFS), PET-POET copolymer (SRP), silicone glycol copolymer (SGC) and polyacrylate. Although the fabric softening action of the softergent composition was improved by the presence in it of the silicone glycol copolymer (SGC), further research was undertaken to increase the anti-static action of such and other nonionic softergent compositions. As a result of that research the present applicants have discovered that such antistatic action of such articles and softergent compositions can be improved by the incorporation in such a softergent composition formula of a certain type of silicone, which will be referred to as Silicone X, a polyethylene terephthalate-polyoxyethylene terephthalate (PET-POET) soil release promoting copolymer, and a polyacrylate, preferably by addition of a 4-member composition of such three components, with the silicone glycol copolymer to the rest of the softergent composition, which includes detergent, builder and cationic fabric softener. Preferably the Silicone X is added in a composition that also contains SRP and polyacrylate, which can replace those components of the softergent composition, and more preferably such 3-member composition can be converted to a 4-member composition by inclusion of the SGC therewith. Such 3- and 4-member additive compositions have been found useful to improve the antistatic activities of both phosphate-built and non-phosphate-built synthetic organic detergent compositions, which is considered to be a significant improvement over the prior art, because in the past non-phosphate built nonionic synthetic organic detergent compositions have not been amenable to such improvement. Additionally, it has been found that nonionic synthetic organic softergent compositions containing the mentioned 3- and 4-member compositions or the components thereof are of improved or maintained softening, brightening, cleaning, stain removal, soil release promoting, perfume stabilizing, water absorbency, cationic softener deposition and pouch evacuation characteristics. Furthermore, when a sub-composition of the silicone, PET-POET copolymer and polyacrylate is prepared by fusion and conversion to particulate form, the antistatic action of the nonionic synthetic organic detergent composition, in which such antistatic composition and post-added SGC are incorporated, preferably as the described 4 -member composition, is better than that of a similar composition which includes the same components, added separately.

Although the mentioned 4-member compositions are preferred and are of best activity in improving antistatic properties of softergents containing nonionic detergent, builder and cationic fabric softener, it has been found that when one omits from them either or both of the SGC and/or polyacrylate one still obtains improvements in antistatic effects on washed and machine dried laundry but such effects, while surprising and useful, are not as great as when the 4-member composition is employed. The previously mentioned 2-, 3- and 4-member compositions may be employed directly to improve antistatic actions of softergents and of wash waters containing softergents comprising nonionic detergent, builder and cationic fabric softener, or they may include cationic fabric softener (making them 4- and 5-member compositions), in which case they may be added to the detergent composition or to wash waters containing nonionic detergent and builder, softener being present in the composition or wash water initially. Also, such 3 to 5-member softening and antistatic compositions may be used as rinse water additives, sprays to be applied to the washed laundry, or as melts or solutions to be applied to substrates, such as paper, polyurethane foams, cloths and other materials, to produce fabric softening and antistatic dryer sheets, and to produce other such antistatic articles.

The aforementioned compositions, articles and processes are novel and neither they nor their advantages have been described or suggested in the art, so they are patentable.

In accordance with the present invention an antistatic and soil release promoting built detergent composition is provided, which comprises a detersive proportion of nonionic detergent, a building proportion of builder for the nonionic detergent, a fabric softening proportion of cationic fabric softening compound and an antistatic action improving and soil release promoting proportion, in combination, of Silicone X and PET-POET copolymer. When the builder is omitted from these compositions they will be less suitable for heavy duty laundering but may still be employed as light duty detergent products, useful for laundering lightly soiled materials, which will usually be of delicate fabrics, and the light duty compositions a are still of improved antistatic actions on the washed items. When the detergent and builder are omitted from such compositions they are useful, with cationic softener, as additives to detergent compositions and as wash cycle additives. Such softener is preferably also present when the invented non-detergent composition is used to make fabric softening and antistatic dryer sheets and similar articles for use in laundry dryers. For such detergent compositions, wash cycle additives, rinse compositions, sprays for fabrics, and dryer products it is also preferable to include the previously mentioned SGC and/or polyacrylate. Processes for manufacturing the described compositions and methods for washing and drying laundry and inhibiting buildups of static charges on washed and dried laundry by use of such compositions and articles are also within this invention.

As was previously mentioned the closest art known to applicants is U.S. patent application Ser. No. 07/098,347. However, among other relevant art there may be mentioned U.S. Pat. Nos. 4,013,573, 4,136,045, 4,419,250 and 4,624, 676, in which silicone, siliconates and organosiloxanes have been taught to be useful components of detergent compositions for various purposes, including soil release promotion, suds suppression, and flow promotion. Additionally, some silicones have been suggested for employment with antistatic agents in antistatic detergent compositions, as in U.S. Pat. No. 3,992,332, others have been taught to be useful lubricants for fibers, sometimes in combination with detergents, as in U.S. Pat. No. 4,578,116, and still others have been suggested for use as fabric softeners, as in U.S. Pat. No. 4,579,964. Still, none of the mentioned references discloses or suggests that the certain type or class of silicones employed by applicants, herein referred to as Silicone X, in combination with the described PET-POET copolymer, would significantly improve the antistatic activity of a cationic fabric softener, such as quaternary ammonium halide, in the various detergent compositions and other non-detergent compositions and articles described herein, and would also improve non-softergent detergent compositions.

Of the various components of the present compositions, nonionic detergent, builders for such detergents, and cationic fabric softeners, such as quaternary ammonium halides, are so well known in the detergent art, which is replete with descriptions of them, that references mentioning them need not be included here. However, brief references to descriptions and sources of other components of the invented compositions and articles will be given although some of such components are also described in the previously mentioned U.S. patent application, Ser. No. 07/098, 347.

PET-POET copolymers, which are useful as soil release promoting agents in detergent compositions, are described in U.S. Pat. No. 3,962,152 and in British patent No. 1,088, 984. Copolymers of such type, but which have been found to be superior in applicants' compositions, are described in U.S. Pat. No. 4,569,772, hereby incorporated by reference. Such copolymers are available from GAF Corporation under the names Alkaril QCF, Alkaril QCJ and SRP-2. There is no teaching in any of the mentioned references that would lead one to incorporate any PET-POET copolymer in a composition with Silicone X, with or without cationic fabric softener, and there is no suggestion that any such composition resulting would be of improved antistatic activity on washed and/or treated laundry.

Sodium polyacrylate has been employed in detergent compositions for various purposes, including suspending and stabilizing functions. In U.S. Pat. No. 4,569,772 soil release promoting PET-POET copolymer (SRP) is stabilized by sodium polyacrylate, by melting such materials together, solidifying the melt and size reducing the solidified material, preferably cryogenically. The patent mentions various low molecular weight sodium polyacrylates, including several sold under the trademark Alcosperse® but there is no teaching in it that such polyacrylates would, in conjunction with SRP, and Silicone X (and SGC), increase antistatic actions of softergents and detergents. Alcosperse 149 is a sodium polyacrylate that has been found to be especially useful in the practice of the present invention. It is manufactured by Alco Chemical Corporation and is described in technical bulletins published by such corporation, which are entitled *Alcosperse Organic polycarboxylate for the Soap and Detergent Industry*, and which are identified as TB 3013 and TB 3017, which bulletins describe uses and properties of the polyacrylate in laundry detergent compositions. However, such bulletins, which are hereby incorporated by reference, do not mention any stabilizing or antistatic action that sodium polyacrylates have on silicones, silicone glycol copolymers or cationic fabric softeners, or on compositions containing such materials, as in built detergents.

Silicone X, an important component of the invented compositions, is described in a U.S. patent application filed on the same date as the present application by Rastko Vukov and Basil A. Behnam, entitled *Hydrolyzable Silicone Polymers*, which is assigned to GAF Chemicals, Corp., and is incorporated by reference.

A silicone glycol copolymer (SGC) that is useful in the compositions of the present invention, 190 Surfactant, sold by Dow Corning Corporation, is described in an information bulletin published by such corporation, which is entitled *Information about Cosmetic Ingredients,* which bulletin contains a 1980 copyright notice. Such material is also identified as dimethicone copolyol (CTFA name) and is described in U.S. Pat. No. 4,302,192, which is hereby incorporated by reference.

With respect to the preferred single use pouch embodiments of the invention, single use packets of detergent compositions and bleaches are described in U.S. Pat. Nos. 4,220,153, 4,286,016, 4,348,293, 3,374,747, 4,410,441 and 4,567,675; British patents 1,578,951, and 1,587,650; and European patent 0,184,261, but applicants' compositions and articles and their discovery of improved antistatic activities of their products are not disclosed by nor are they obvious from any of the mentioned patents and/or publications.

The invented compositions, both phosphate-built and non-phosphate-built nonionic synthetic organic softergent and detergent compositions, are of improved antistatic properties. In a plant which manufactures both such types of softergents the applicants' invented 4-member subcombination additive for such compositions may be admixed with either type of softergent and in both cases will improve antistatic action of the softergent compositions. In the case of the non-phosphate built softergent compositions antistatic action on washed cotton, cotton/polyester blend and polyester laundry equals that of commercial fabric softening and antistatic dryer sheets, which is surprising in view of the fact that the cationic fabric softener of the dryer sheets is applied directly to the laundry in the dryer whereas applicants' compositions contact the laundry in dilute wash water solution and have to adhere to the laundry and "survive" washing, rinsing and drying operations. With respect to the phosphate-built softergent compositions antistatic activity is significantly improved for such softergent formulas containing the mentioned 3-member and 4-member sub-compositions (the 3 -member sub-composition does not include the silicone glycol copolymer), although it is not equivalent to that of the dryer sheets containing cationic fabric softener. Still, the improvement is unexpected and beneficial.

The reason why the invented antistatic detergent compositions are better in antistatic activity has not been established. It has been theorized that the combination of Silicone X and SRP acts to hold the cationic softener/antistat (often preferably a quaternary ammonium salt) to the fibers of the laundry materials, preventing washing out of such cationic compound with the rinse water. Apparently each of the silicone and the SRP acts in its own way to help to hold the cationic material to the fibrous substrate and the effect of the combination is superior to the effect of either component alone, even if in increased proportion. The polyacrylate helps to stabilize components of the detergent compositions, especially during storage at elevated temperature, and thereby helps to improve holding of the cationic compound to the laundry in the wash water. Additionally, the Silicone X and the SGC possess fabric softening properties in the present compositions. When all three of the components of the sub-composition discussed above (Silicone X, SRP and polyacrylate) are fused together and subsequently size reduced, as by cooling to solid form and grinding (which is preferably cryogenic grinding), surprisingly, the antistatic action thereof and of the described four-member sub-compositions (which also include the SGC) on built nonionic softergents is improved over that resulting when merely mixed compositions of such components are utilized in such softergents.

When the silicone glycol copolymer of the present detergent compositions (the fourth component of the sub-compositions) is added to the three-member "fused" sub-composition it significantly improves the antistatic action of the detergent composition resulting when such is added to a built nonionic softergent, when the resulting antistatic softergent composition is employed to wash laundry. The reason for this improvement is not understood although it has been theorized that the SGC increases deposition of the cationic component on laundry fibers or improves the distribution of such cationic compound over the laundry, thereby making it more effective. However, built detergents are also improved.

Although several theories to explain the desirable improvements noted in use of the invented softergent compositions have been advanced above, the present application should not be limited by such theories, which have not been sufficiently confirmed. Nevertheless, it has been observed that significantly lower quantities of fabric softening cationic compounds may be employed to effect satisfactory antistatic softening of washed laundry when the described 4-member sub-compositions are present in known nonionic fabric softening laundry detergent compositions, compared to when they are omitted. Also, the addition of the 3-member sub-composition to softergents containing SGC (such as the detergent compositions of Ser. No. 07/098,347) improves the antistatic activities of such compositions, and of the dispensing articles (or pouches) in which such compositions are packed for use.

Although the present invention relates largely to compositions and processes for their manufacture and use, in a preferred embodiment a softergent composition of the invention is enclosed in a packet or pouch, from which the pre-measured softergent composition is released into wash water in an automatic washing machine. Such embodiment of the invention will be readily understood from the description thereof herein, taken in conjunction with the accompanying drawing, in which.

Figure 1:
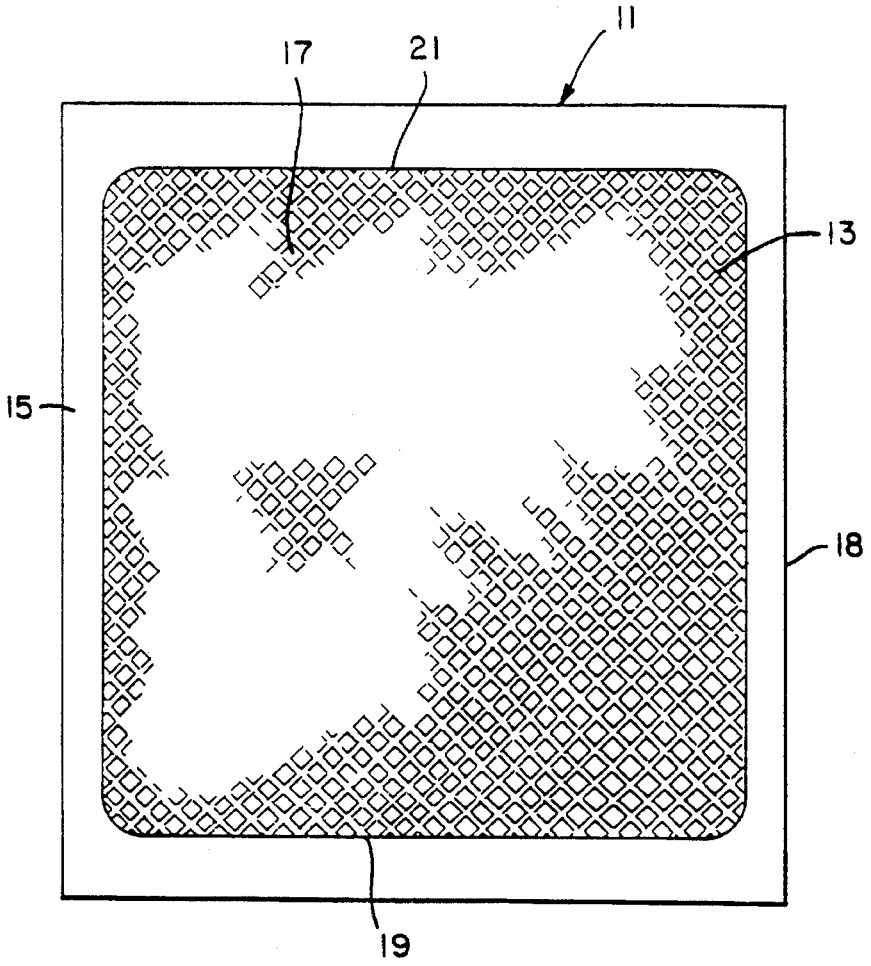
FIG. 1 is a top plan view of an article of the invention.

In FIG. 1 pre-weighed fabric softening, antistatic and soil release promoting detergent or softergent article 11, suitable for addition to an automatic washing machine to wash an average load of laundry therein, comprises two sheets of non-woven polyester fabric, an upper sheet 13 and a lower sheet (not visible), which are heat sealed together along the four sides thereof, represented by numeral 15. Polyester fabric 13 is fabricated with diamond-shaped patterns, such as that illustrated in 17, which patterns extend over both surfaces of the sheet but which are flattened out by heat sealing along the sides thereof, at 15. The invented particulate detergent or softergent composition (not visible) is contained in pouch 18, with that numeral designating the permeable covering of article 11 about the particulate contents thereof.

Article 11 is of flat pillow shape, with the thickness thereof usually being in the range of 0.01 to 0.2 times the width of the portion of the pouch containing particulate detergent (that portion "inside" the heat sealed article sides). Ends of the pouch are illustrated at 19 and 21 but due to the plan nature of the illustration the thickness thereof is not indicated.

Figure 2:
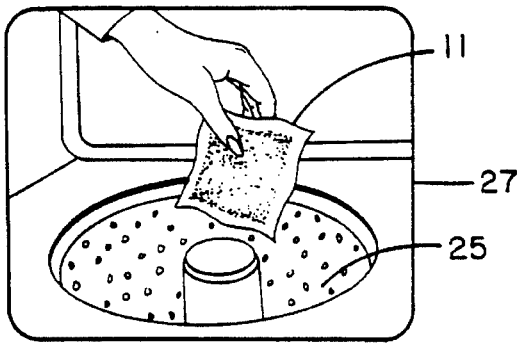
FIG. 2 is a perspective view of such article being added to the wash tub of an automatic washing machine.

In FIG. 2 there is shown article 11 being added to wash water (not shown) in tub 25 of top loading washing machine 27. Such addition is made before clothing and other items to be laundered are added to the wash water. After washing of the laundry, it and the emptied pouch are charged to the laundry dryer (or clothes dryer) and dried under usual tumble drying conditions. In the usual laundry dryer operation, due to relative motion of the drying laundry and the walls of the drying drum, static charges tend to accumulate on the laundry, especially when the ambient air is of low humidity. Because of the deposition onto the washed laundry of the Silicone X, SGC, SRP and CFS from the water any tendency of the laundry to accumulate static charges is counteracted, and static-free or essentially static-free cotton, polyester and cotton/polyester blend laundry items result. Similar results, but not as good, are obtained when the softergent article includes a light duty softergent composition, which omits builder, when the articles washed are comparatively delicate items that are only lightly soiled initially, and which are washed by hand and only tumble dried at low temperature. Also, similar antistatic action, but to a lesser extent is obtained when the compositions in the articles omit the polyacrylate and/or SGC.

The nonionic detergent of the present compositions is any suitable nonionic detergent, which class is well known in the art, with many members thereof being described in the various annual issues of *Detergents and Emulsifiers*, by John W. McCutcheon, for example, the 1973 Annual. Such volumes give chemical formulas and trade names for virtually all commercial nonionic detergents that were then marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl [octyl, nonyl and isooctyl] phenols may also be employed). The higher fatty moieties, such as the alkyls, of such alcohols and resulting condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures, the numbers of carbon atoms given are necessarily averages but in some instances the ranges of numbers of carbon atoms may be actual limits for the alcohols employed and for the corresponding alkyls.

The ethylene oxide (EtO) contents of the nonionic detergents will normally be in the range of 3 to 15 moles of EtO per mole of higher fatty alcohol, although as much as 20 moles of EtO may be present. Preferably such EtO content will be 3 to 10 moles and more preferably it will be 6 to 7 moles, e.g., 6.5 or 7 moles per mole of higher fatty alcohol (and per mole of nonionic detergent). As with the higher fatty alcohol, the polyethoxylate limits given are also limits on the averages of the numbers of EtO groups present in the condensation product. Both broad range ethoxylates and narrow range ethoxylate (BRE's and NRE's) may be employed, with the difference between them being in the "spread" of number of ethoxylate groups present, which average within the ranges given. For example, NRE's which average 5 to 10 EtO groups per mole in the nonionic detergent will have at least 70% of the EtO content in polyethoxy groups of 4 to 12 moles of EtO and will preferably have over 85% of the EtO content in such range. BRE nonionic detergents have a broader range of ethoxy contents than NRE's, often with a spread from 1 to 15 moles of EtO when the EtO chain is in the 5 to 10 EtO range (average). Examples of the BRE nonionic detergents include those sold by Shell Chemical Company under the trademark Neodol®, including Neodol 25-7, Neodol 23-6.5 and Neodol 25-3. Supplies of NRE nonionic detergents have been obtained from Shell Development Company, which identified such materials as 23-7P and 23-7Z, and from Union Carbide Corporation, which identifies such a preferred product as Tergitol® D24-L-60N (Tergitols 24-L-45N, 24-L-75N and 26-L-60N are other NRE nonionic detergents which also may be used in partial or complete replacement of Tergitol 24-L-60N). The present NRE's and "corresponding" BRE's (based on similar alcohols and EtO contents) are described in U.S. patent application Ser. No. 07/084,524, which recites advantages of the NRE's over BRE's. Such application is hereby incorporated herein by reference.

The builder for the nonionic detergent may be any suitable water soluble or water insoluble builder, either inorganic or organic, providing that it is useful as a builder for the particular nonionic detergent or mixture of nonionic detergents that may be employed. Such builders are well known to those of skill in the detergent art and include: alkali metal phosphates, such as alkali metal polyphosphates and pyrophosphates, including alkali metal tripolyphosphates; alkali metal silicates, including those of $Na_2O:SiO_2$ ratio in the range of 1:1.6 to 1:3.0, preferably 1:2.0 to 1:2.8, and more preferably 1:2.35 or 1:2.4; alkali metal carbonates; alkali metal bicarbonates; alkali metal sesquicarbonates (which may be considered to be a mixture of alkali metal carbonates and alkali metal bicarbonates); alkali metal borates, e.g., borax; alkali metal citrates; alkali metal gluconates; alkali metal nitrilotriacetates; zeolites, preferably hydrated zeolites, such as hydrated Zeolite A, Zeolite X and Zeolite Y; and mixtures of individual builders within one or more of such types of builders. Preferably the builders will be sodium salts and will also be inorganic. A highly preferred non-phosphate mixed water soluble and water insoluble builder composition comprises carbonate, bicarbonate and zeolite builders. Phosphate-containing builder systems will usually be based on alkali metal (sodium) tripolyphosphate and silicate builders, with such silicate being in relatively minor proportion.

The various builders need no further description except, perhaps, for the zeolite. Such builder is water insoluble and is preferably hydrated, as with from 4 to 35% of water of hydration, preferably 5 to 30%, more preferably 10 or 15 to 25%, and most preferably, 17 to 22%, e.g., about 20%. The zeolite is normally in a finely divided state, with particle sizes often being less than No. 200 sieve, as may also be the situation for various adjuvants that are added in powder form. Normally the zeolite particle sizes will be in the range of No's. 100 to 400, preferably 140 to 325, U.S. Sieve Series, but such particles may be agglomerated to builder bead size, too, with or without other builder(s) in such agglomerates. The ultimate particle diameter of the zeolite will be in the range of 0.01 to 20 microns, more preferably 0.01 to 15 microns, e.g., 3 or 12 microns, and most preferably 0.01 to 8 microns, mean particle size, e.g., 3 to 7 microns, if crystalline, and 0.01 to 0.1 micron, if amorphous. Zeolites and other water insoluble builders will not be employed in the detergent or softergent compositions if they do not pass through the permeable pouch wall during the washing operation. Of course if another type of pouch is utilized, such as one which dissolves or opens in the wash water, zeolites of various sizes may be employed.

The fabric softening cationic compound may be any suitable such compound, such as an imidazolinium salt or a quaternary ammonium salt. Both types of fabric softeners are described in U.S. Pat. No. 4,000,077, which is incorporated herein by reference. Of the two types of softeners the quaternary ammonium salts are preferred, and of these the quaternary ammonium halides, such as the quaternary ammonium chlorides, are more preferred.

The quaternary ammonium salt fabric softening compound is preferably of the formula

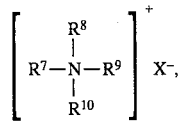

wherein $R^7$ and $R^8$ are lower alkyls of 1 to 3 carbon atoms, $R^9$ is higher alkyl of 10 to 20 carbon atoms, $R^{10}$ is alkyl of 1 to 20 carbon atoms, and $X^-$ is a salt forming anion, preferably either chlorine or bromine, and more preferably chlorine. In such quaternary salts $R^7$ and $R^8$ are preferably the same lower alkyl and $R^9$ and $R^{10}$ are preferably the same higher alkyl, with the most preferred fabric softener being dimethyl distearyl ammonium chloride. The useful quaternary ammonium halides include those wherein the higher alkyls are tallow-alkyl or hydrogenated tallowalkyl, cetyl, myristyl and/or lauryl, and wherein the lower alkyls are methyl and/or ethyl.

The Silicone X type components that are useful in the invention are polymers that are characterized by the presence of one or more alkyl polyfunctional hydrolyzable silyl radicals and the availability of such radicals in spaced relationship from the polysiloxane polymer backbone. Such polymers may be of the structure

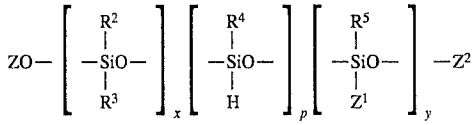

(I)

wherein $R^2$ and $R^3$ are each independently alkyl or aryl, which may be substituted with lower alkyl (of 1 to 4 carbon atoms);

$R^4$ is hydrogen or $R^2$;

$Z^1$ is $—CH_2CHA—(CH_2)_rSi(R^1)_3$;

Z and $Z^2$ are each independently $(R^6)_nSiH_{(3-n)}$ or $—CH_2CHA—(CH_2)_rSi(R^1)_3$;

n is 0 to 3;

$R^6$ is alkyl, alkoxy, phenoxy or aryl, which may be substituted with lower alkyl;

$R^5$ is $R^2$or $Z^1$;

x is 2 to 1000;

y is 1 to 200;

p is 0 to about 50% of y;

A is hydrogen, alkyl or phenyl;

r is 0 to 12; and $R^1$ is hydroxy, acyloxy, halogen, amino, alkoxy, aryloxy or aryloxy substituted with lower alkyl, halogen or acyloxy.

In the preferred compounds Z and $Z^2$ are each independently $(R^6)_nSiH_{(3-n)}$ wherein $R^6$ is alkyl of 1 to 18 carbon atoms, preferably methyl n is 3, p is zero, $R^2$, $R^3$ and $R^5$ are independently methyl and/or ethyl, $Z^1$ is $—CH_2CHA—(CH_2)_rSi(R^1)_3$, wherein A is hydrogen, r is 0 to 6, preferably about zero, $R^1$ is lower alkoxy of 1 to 4 carbon atoms, preferably methoxy, x is in the range of 20 to 200 and y is in the range of 1 to 15. In a more preferable embodiment of such compounds x is in the range of 30 to 170, e.g., 40, 100 or 160, and y is in the range of 1 to 10, e.g., 2, 6, or 8. In specific examples of such compounds x is about 160 and y is about 2, x is about 160 and y is about 8, and x is about 40 and y is about 6 (x:y=160:2, 160:8 and 40:6).

Such preferred compounds, as described in the preceding paragraph are represented by the following formula

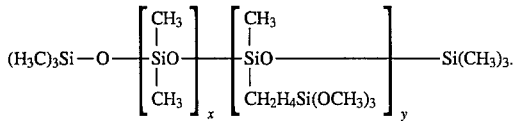

(II)

It will be noted that the alkoxy groups of the formula are hydrolyzable to hydroxy groups by water.

The above described Silicone X polymers may be prepared by reacting a silane which contains hydrogen, a silicone, or a siloxy compound with an aliphatically unsaturated silane under relatively mild reaction conditions. Such reaction is preferably carried out at a temperature in the range of 80° to 120° C. and a pressure in the range of 0 to 4 kg./sq. cm. for about 1 to 8 hours, in the presence of a small amount of an acidic platinum group metal catalyst, such as between about 20 and 200 parts per million, based on the total of reactants. The reaction is preferably effected in an inert solvent, such as benzene, toluene, xylene or dimethyl formamide, with the concentration of the reactants in the solvent being in the range of 10 to 20%,and the reaction product will normally have a molecular weight in the range of 400 to 400,000, preferably 4,000 to 20,000. The equation for the reaction is

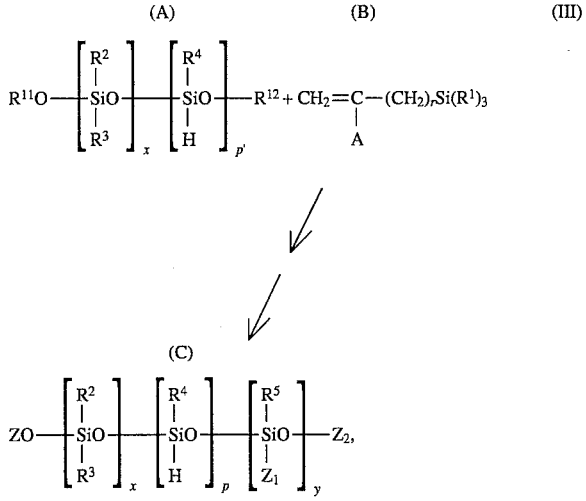

(III)

wherein $R^{11}$ and $R^{12}$ are each independently $(R^6)_nSi\ H_{(3-n)}$, wherein n is 0 to 3 p is 1 to 200 and Z, $Z^1$, $Z^2$, $R^1$, $R^2$, $R^3$, $R^4$, $R^5$, $R^6$, A, x, y, p and r are as defined in Formula I or Formula II.

Reactant A can be prepared by methods which are known in the art, one of which is described in Example 5 of U.S. Pat. No. 4,331,555, incorporated herein by reference. Reactant B is known, and may be prepared by the method described in *Silicon Reagents in Organic Synthesis,* by E. W. Colvin, published by Academic Press (1988), which is also incorporated herein by reference. Furthermore, the described reactions to form Silicone X type polymers are detailed in the U.S. patent application of Vukov et al., previously referred to herein.

Instead of the described Silicone X type polymers there may also be employed in the present compositions other such hydrolyzable silicone polymers which have similar antistatic characteristic improving properties in applicants' described compositions. However, the polymers mentioned herein are considered to be those which are most preferred and which result in best antistatic actions.

The polyethylene terephthalate-polyoxyethylene terephthalate (PET-POET) soil release promoting copolymers (SRP's) that are useful in the invented compositions are those which are effective in such compositions to help improve antistatic actions of the described softergents and detergents. Such usually are of molecular weights (weight averaged) in the range of 15,000 to 50,000, preferably 19,000 to 43,000, and more preferably 20,000 to 35,000 or 40,000, e.g., about 30,000. Preferably, the molecular weight of the polyoxyethylene thereof is in the range of about 2,500 to 5,000, the molar ratio of PET:POET units is in the range of 2:1 to 5:1, and the proportion of ethylene oxide to phthalic moiety in the copolymer is in the range of 20:1 to 30:1. Such PET-POET soil release promoting copolymers are available from GAF Corporation, under the names Alkaril® QCF, Alkaril QCJ and SRP-2.

The polyacrylates employed in the present invention may be in acid form or in salt form, and may be of various molecular weights, so long as they are water soluble and effective stabilizers. However, the molecular weight will usually be in the range of 1,000 to 10,000, preferably 1,000 to 5,000 and more preferably 1,000 to 3,000, with an average molecular weight of about 2,000 often being most preferable. Also, normally the sodium salt will be employed. A preferred polyacrylate, Alcosperse® 149, which is sold by Alco Chemical Corp. is a sodium polyacrylate of a molecular weight of about 2,000, but Alcosperses 104, 107, 107D and 109 are also operative.

The silicone glycol copolymer (SGC) is a copolymer with the silicone of a mixed ethylene oxide-propylene oxide or ethylene glycol-propylene glycol copolymer (designated EtO-PrO copolymer, for conciseness), in which the EtO-PrO copolymer moieties are joined to silicone silicon atoms through lower alkylene groups. A suitable such silicone glycol copolymer product is 190 Surfactant, which is described in the Dow Corning publication previously mentioned. Such material is in liquid form at room temperature, is soluble in water, ethanol and water-ethanol systems and is hydrolyrically stable. It is of a lower surface tension than water, being comparable in this respect to aqueous synthetic organic detergent solutions and soap solutions,. Its specific gravity is slightly higher than that of water, and it approaches water whiteness in appearance. Such silicone glycol copolymer (SGC) is non-oily, essentially non-toxic and non-sensitizing, stable and inert, and is of inverse solubility, with its inverse solubility point (0.1% aqueous solution) being about 36° C. The HLB number for 190 Surfactant is in the range of 4 to 7, and often can be about 5.7, and such range may be desirably applied to determine other operative SGC's, but other similarly active SGC's, of HLB's up to 19, can also be employed.

The silicone glycol copolymer (190 Surfactant) has been reported to be like such copolymers that are described in U.S. Pat. No. 3,402,192, previously mentioned herein. Such copolymers are of the formula

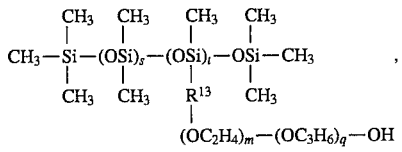

wherein $R^{13}$ is a hydrocarbyl radical of 1 to 10 carbon atoms, x is 6 to 420, t is 3 to 30, and m+q=25 to 100, with the molar proportion of ethoxy groups to propoxy groups being in the range of 1:4 to 7:3. In that formula $R^{13}$ is preferably lower alkylene of 1 to 4 carbon atoms, most preferably and more preferably 3 or about 3 carbon atoms. In such formula s is preferably 10 to 350 and more preferably is 20 to 200, t is preferably 5 to 25 and more preferably is 8 to 20, m+q is preferably 40 to 80 and more preferably is 45 to 75, and the molar proportion of ethoxy groups to propoxy groups is preferably in the range of 1:2 to 2:1, and more preferably is in the range of 2:3 to 3:2. Other silicone glycol copolymers and related compounds which may be useful in the practice of the present invention include various Silwets available from Union Carbide Corporation, such as Silwet® L-7001, and Ucarsils, e.g., Ucarsil® EPS and Ucarsil DJ.

It has also been found that certain amino functional silicones, such as that sold by Union Carbide Corporation under the trade name Magnasoft Ultra, can be substituted for the described SGC's in the present compositions, and good antistatic action will result. Furthermore, such substitution can also result in improved fabric softening. Such amino functional silicones are of the formula

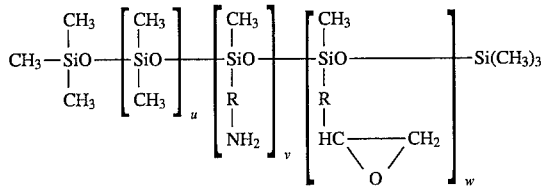

wherein R, u, v and w are such as to result in a silicone of desired properties. Usually, it is expected, R will be lower alkylene, of 2 to 6 carbon atoms and u, v and w will each be in the range of 0 to 300.

Other components may be present in the detergent and softergent composition to improve the properties and in some cases, to act as diluents or fillers. Among the suitable fillers the one most preferred is sodium sulfate. Illustrative of suitable adjuvants are enzymes, which may be present to promote cleaning of hard to remove stains from the laundry. Of the enzymes the most useful in laundering operations are the proteolytic and amylolytic enzymes, preferably in mixture. Among other useful adjuvants are foaming agents, such as laurie myristic diethanolamide, when foam is desired, and anti-foams, when desired, such as dimethyl silicone fluids. Also useful are bleaches, such as sodium perborate, which may be accompanied by suitable activator(s) to promote bleaching actions in warm or cold water. Flow promoting agents, such as hydrated synthetic calcium silicate, which is sold under the trademark Microcel® C, may be employed in relatively small proportions for their mentioned function. Other adjuvants that are usually present in the invented fabric softening detergent compositions include fluorescent brighteners, such as the stilbene brighteners; perfumes; and colorants, including dyes and water dispersible pigments. There will also usually be a minor proportion of water present in these particulate products, either free or as water of hydration.

The proportions of those of the mentioned components of the present compositions as are of significance with respect to the operation and advantages of the invention are chosen to produce the most important desired results, good detergency, good antistatic action, no "quat-spotting" or yellowing of washed laundry, and no significant adverse effects of the quaternary ammonium halide softening agent on any fluorescent brightener that may also be present in the compositions.

For the two-part compositions that may be utilized in making the other invented compositions, comprising silicone and PET-POET copolymer, the proportions are normally in the ranges of 2 to 30 and 40 to 95, respectively, preferably being in the ranges of 5 to 20 and 55 to 85 parts by weight. More preferably such proportions are 10 to 15 and 65 to 80, and most preferably 11 to 13 and 70 to 80. When CFS is also present in such compositions, which is normal when such 3-member compositions are to be used as wash cycle additives or as supplements to detergent compositions to convert such to antistatic softergents or to give wash waters such properties, such ranges thereof will be 20 to 100, 30 to 90, 40 to 80 and 50 to 70, respectively. With no CFS present the other proportions are the same.

The proportions of polyacrylate which may be present in such compositions, with or without CFS, are 1 to 8, 2 to 7, 3 to 7 and 4 to 6, respectively. The proportions of SGC, which may also be present with or without either or both of the CFS and polyacrylate, will be 2 to 30, 5 to 20, 7 to 13 and 8 to 11, respectively. The SGC may be at least partially replaced, in some compositions, by other lower alkoxylated, epoxy-substituted or amino-substituted silicone polymers, of types described in this specification.

In the invented softergent compositions the proportions of components will be a detersive proportion of the nonionic synthetic organic detergent, a building proportion of the builder, a fabric softening proportion of the cationic fabric softening compound and an antistatic and soil release promoting proportion of the Silicone X, SRP, SGC and polyacrylate, in the proportions previously mentioned. Some specific ranges for such components of the invented detergent compositions are 8 to 30% of nonionic detergent, 30 to 70% of builder for the nonionic detergent, 0.5 to 10% of CFS, 0.1 to 2% of silicone, 0.2 to 0.7% of sodium polyacrylate, 1 to 10% of SRP and 0.1 to 2% of SGC. Preferably, for phosphate-built compositions, the proportions of components will be 12 to 25% of the nonionic detergent, 35 to 65% of sodium tripolyphosphate, 2 to 10% of sodium silicate, 1 to 6% of CFS, 1.0 to 1.5% of Silicone X, 0.3 to 0.7% of sodium polyacrylate, 6.5 to 8% of SRP and also 0.7 to 1.3% of SGC. For the non-phosphate softergent compositions such proportions will be 12 to 25% of nonionic detergent, 15 to 35% of sodium carbonate, 5 to 20% of sodium bicarbonate, 10 to 35% of hydrated zeolite, as the anhydride, 1 to 6% of CFS, 0.5 to 1.5% of Silicone X, 0.3 to 0.7% of sodium polyacrylate, 1 to 10% of SRP and 0.1 to 2% of SGC. Similar proportions of components may be present in the wash waters produced by addition of the invented softergents to water or produced by addition of invented wash cycle additives to wash waters containing detergent or softergent compositions. If desired, the SGC and polyacrylate may be omitted from the detergent compositions, but it is preferred to include them for best antistatic and softergent effects.

The proportion of filler in such softergent compositions will usually be in the range of 0 to 40%, such as 5 to 20%, when present. However, often no filler salt will be added, although some may be included in the formula for flow improving characteristics or because of being present in some commercial sources of components being employed. The proportions of adjuvants present in the mentioned compositions will normally be less than 2% each and the total will usually be less than 10% of the composition, but for particular adjuvants, such as bleaching agents, e.g., sodium perborate monohydrate, as much as 35% can be present. Preferably, however, for non-bleaching detergent compositions, the total proportion of adjuvants will be less than 5% and often it will be in the range of 0.1 to 2%.

To manufacture the invented two-member compositions of Silicone X and SRP all that is required is to fuse together the components thereof and then to convert the fused mix to particulate solid form. Such conversion may be effected by cooling to solidification, followed by size reduction, or by spray cooling, or film drying followed by grinding of the film. Preferably, the mix is heated to a temperature in the range of 150° to 200° C. and is then cooled to solidify it, after which it is size reduced so that it will pass through a No. 10 sieve (U.S. Sieve Series). Instead of merely melting the mix by raising it to an elevated temperature, it has been found desirable to hold it at that temperature for a period long enough to permit some reaction or interaction between the components, which has been found to improve the antistatic action of nonionic detergent compositions to which the resulting composition has been added. For example, when the temperature of the mix is raised to about 200° C. it is often more preferred to hold it at such temperature for about two hours. The preferred grinding operation is cryogenic grinding and preferably the particulate material resulting will be of a particle size that passes through a No. 20 sieve, and more preferably, such particles will pass through a No. 40 sieve. Normally, it will be desirable to size reduce the melt or solidified melt so that few, if any, particles are smaller than No. 100 sieve, and if such are present, they may be removed.

Although grinding and other such forms of mechanical size reduction are operative for manufacturing the invented particulate two-member compositions and have been successfully employed in the past, such compositions may also be desirably solidified by spray cooling techniques, in which droplets of the molten mix are cooled while falling through an upwardly moving current of air. It is also within the present invention to spray the molten two-member mix onto particulate detergent compositions, which may contain SGC too. Preferably, if such a process is employed such spraying will be subsequent to absorption of liquid state nonionic detergent by such base beads.

Although it is highly preferred to make the two-member composition by fusing the components thereof and subsequently producing particulate product from the melt, it is feasible merely mechanically to mix them or to include the two components in the final detergent composition in any suitable manner. However, if such procedures are followed there is an appreciable loss in antistatic action of the detergent compositions that result, compared to those made by a process that utilizes a fusion step.

The Silicone X-SRP two-member composition described above (or the components thereof) is useful to improve the antistatic activity of the CFS and of detergent compositions, with or without CFS. When a built nonionic detergent composition is to be converted to an antistatic softergent it will normally be desirable to include the CFS with the two-member composition. While the CFS may be a component of the melt, it may also be added in particulate or other convenient form to the two-member composition made by fusion, solidification and size reduction. If the CFS is already in the detergent composition (in which case it is a softergent composition), addition of the two-member Silicone X-SRP composition will improve the antistatic properties of the product.

To improve the antistatic properties, stability, soil release promotion and cleaning power of the additive compositions or of the softergent compositions made with them, it will also be desirable to include with the two-member and three-member compositions sodium polyacrylate and SGC (or equivalent material), thereby making such compositions into three-, four- and five-member compositions. Normally, the polyacrylate is included in the melt but the SGC is usually post-added. The various components are normally in particulate form, usually of particle sizes in the ranges given above for the size-reduced two-member compositions. When any component of the various non-detergent compositions mentioned is already included in the detergent composition in desired or lesser proportion it may be omitted from or may be only partially present in the additive composition. Otherwise, the proportions of the various components of the additive composition will be those mentioned above. For example, GAF Corporation supplies a three-member particulate composition made by fusion, cooling and size reduction, which is composed of 76.5% of Alkaril SRP-2F, 13.5% of Alkasil HNM-1223-15 (Silicone X) and 10% of Alcosperse 149D, under their designation Alkaril 1046-190B, which has been code named MAPS.

The described non-detergent compositions are normally in particulate form and are useful additives to detergents, softergents and wash waters. Some such compositions are useful additives to rinse waters, and usually such compositions contain CFS. Such rinse water additive compositions are also useful, when dissolved in volatile solvent, such as aqueous alcohol, or chloroflourinated lower hydrocarbon propellent, as a spray to be applied to fabrics to make them softer and antistatic. Also, solutions, emulsions and dispersions of the various components may be made, so that the additives may be used in liquid state. Additionally, solutions, emulsions or fine dispersions of such compositions may be applied to papers and cloths to convert them to dryer products, which release the solute of the solution applied onto the laundry during machine drying operations, thereby making the laundry softer and antistatic. In such applications the SRP also deposits on the laundry and helps to promote the release of subsequently applied soils during subsequent washings.

The "base beads" utilized in making the detergent compositions of this invention may be made by conventional spray drying techniques, such as are described in U.S. patent application Ser. No. 07/098,347. Suffice it to say here that the inorganic builder portion of the detergent composition formula is mixed with water to form an aqueous crutcher mix, usually at a solids content in the range of 40 or 50 to 75%, which is at a temperature in the range of 40° to 75° C. Such crutcher mix is spray dried in a conventional spray tower at a drying gas temperature in the range of 250° to 450° C. to produce substantially globular beads of particle sizes in the range of No's. 10 to 100, preferably 10 to 70, U.S. Sieve Series. If excess fines and coarse particles result from the spray drying operation such may be removed by classification and/or sieving operations.

The base beads made are very absorptive (especially the sodium tripolyphosphate beads) and the nonionic detergent, in liquid state, usually at an elevated temperature in the range of 40° to 60° C., is sprayed onto moving surfaces of the base beads insuitable mixing equipment, so as to produce a substantially free flowing particulate detergent product. In a variation of the described processing, a mutual solution of the SGC and nonionic detergent may be made beforehand, by heating them to an elevated temperature, as in the range of 40° to 60° C., and such mutual solution may be sprayed onto the moving base beads, to be absorbed by them. Subsequently, the cationic fabric softener, normally in particulate form, is mixed with such detergent beads, when the extra effect of the CFS is desired.

The various adjuvants that may be employed may be included in the crutcher mix and spray dried in the base beads, may be added with the nonionic detergent, sometimes being dissolved therein or fused therewith, may be added with the cationic fabric softener or with the antistatic additive composition, or may be admixed subsequently, following whichever procedure appears to be most desirable under the circumstances. Also, the invented compositions may be made by mixing together the various components thereof, in suitable forms, either solid, particulate solid or liquid, and may be agglomerated or size reduced. However, mere mixtures of components do not usually result in a detergent composition as effective in antistatic action as the preferred compositions of this invention, in which at least portions thereof had been heated, fused, cooled, solidified and size reduced.

The described softergent compositions can be added directly to the wash water or may be packaged in suitable pouches, which release the softergent composition into the wash water during the washing process, so that laundry in the wash water may be washed and rendered antistatic by the composition components. The pouch material is preferably of non-woven, water insoluble fibrous material, such as polyester fibers, so that it is water permeable but does not allow the passage through it of the detergent composition before the packet is added to the wash water. Such packets and water permeable non-woven sheet material used to make them, usually by heat sealing edges thereof, are described in detail in U.S. patent application Ser. No. 07/098,347. Such packets will normally be of a thickness in the range of 0.1 to 1 mm., of a weight in the range of 35 to 45 g./sq. m. and of an air permeability in the range of 1 to 3 cu. m./min./sq. cm. The preferred fibers are of two to four denier and the pouch material is preferably one manufactured by Veratech, Inc., which material is described by their specification numbers 149-026, SP284, SP284.1, SP289 and SP289.1. Although the preferred packets or pouches are those which are water permeable, it is also within the invention to utilize other pouch materials and pouches which open in the wash water to allow release of the packet contents. The charge of detergent composition to a packet will normally be in the range of 10 to 200 grams, preferably being 30 to 100 g. and more preferably being 40 to 50 g., e.g., 44 or 45 g.

When the invented compositions or articles are employed in the washing and drying of laundry the concentration of such composition in the wash water will normally be in the range of 0.015 to 0.3%, preferably being in the range of 0.045 to 0.15% and more preferably being in the range of 0.050 to 0.100%, e.g., about 0.06 or 0.07%. The percentages of individual components in the wash water may be calculated from such ranges, using as a basis a formula of the most preferred composition, as previously described. For the non-detergent additives, the proportions added to wash waters will be sufficient to make the effective charge of softergent to such water within the components' ranges given previously. When sprays or impregnating solutions, etc. for treating paper or cloths to make dryer products are made, the concentration of the components in solvent will usually be in the range of 10 to 50%, e.g., 20%, by weight.

In use of the invented compositions and articles the consumer fills the washing machine with water, which may be of any hardness, such as up to 400 p.p.m., as $CaCO_3$, but preferably is of a hardness in the range of 25 to 150 p.p.m. The wash water, at a temperature in the range of 15° to 70° C., usually 20° to 40° C. is normally of a volume in the range of 50 to 75 liters per wash, e.g., 64 l., and to such wash water one of the invented 45 g. articles is added for lightly or normally soiled laundry, with two packets (or equivalent weights of compositions) being employed for more heavily soiled laundry. The laundry to be washed is then added to the washing machine, with the weight charged usually being in a range of 2 to 4 kg., and washing is commenced. The wash cycle normally takes from 10 minutes to one hour, preferably 15 to 30 minutes, and after washing, the laundry is usually automatically rinsed two or three times. It is then spin dried or otherwise has the remaining rinse water expressed from it, and is removed from the washing machine in damp state, together with the fabric softening detersive article(s), if such are employed. With such article(s), it is placed in an automatic laundry dryer, where it is subjected to hot, warm or room temperature air drying, depending on fabric types. After completion of drying, tests of the laundry will show that it is satisfactorily cleaned, antistatic, and soft, and contains spots or yellow stains due to the quaternary fabric softener, and is satisfactorily brightened by the stilbene brightener of the composition, when such is present. Examination of the invented article, upon removal from the dried laundry, normally shows that it has been completely evaculated of initially contained fabric softening detergent composition particles. Under poor conditions for solubilizing, as when the wash water is cool or cold, and gentle or minimal agitation is employed, sometimes a small proportion of the builder salt, usually less than 5% and often less than 1% of the amount initially present, remains in the pouch. However, under normal conditions and often even under adverse conditions, when the invented article is removed from the washing machine and is not added to the dryer it will usually be found that the contents thereof have been completely evacuated, or that only a very small proportion, less than 1% thereof, remains, evidencing that during the wash cycle (and possibly also during any rinsing cycles) the cationic fabric softener was transported through the permeable pouch to the wash water and possibly also to the rinse water, wherein it performed its designed function as an antistatic agent on the washed laundry.

Instead of using the invented articles the softergent or detergent compositions may be employed or a two-, three- or four-member composition of the invention may be added to the wash water (containing softergent) in the washing machine (as a so-called wash cycle additive), and essentially the same favorable results are obtained. Such results will also be obtained when a three-, four- or five-member composition of the invention is added to wash water containing a built nonionic detergent composition (without CFS), or to softergent (with CFS).

The following examples illustrate but do not limit the present invention. All parts are by weight and all temperatures are in °C. in such examples, this specification and the appended claims, unless otherwise indicated.

EXAMPLE 1

| Components | Percent (by weight) A | Percent (by weight) B |
|---|---|---|
| Part I (base beads [non-phosphate]) | 64.87 | |
| Sodium carbonate | | 24.54 |
| Sodium bicarbonate | | 10.00 |
| Zeolite A (anhydrous basis) | | 23.64 |
| Water | | 6.69 |
| Part II | 19.29 | |
| * Nonionic detergent (condensation product of higher fatty alcohol of 12 to 15 carbon atoms with 7 moles ethylene oxide per mole [BRE]) | | 17.78 |
| ** Silicone glycol copolymer | | 1.11 |
| Perfume | | 0.40 |
| Part III | 15.84 | |
| + Multi-action polymer particles | | 8.36 |
| ++ Distearyl dimethyl ammonium chloride | | 6.67 |
| BBH stilbene fluorescent brightener | | 0.56 |
| Calcium silicate powder (Microcel ® C) | | 0.25 |
| | 100.00 | 100.00 |

* Neodol ® 25-7, mfd. by Shell Chemical Co.
** 190 Silicone Surfactant, mfd. by Dow Chemical Co.
\+ MAPS, mfd. by GAF Corp., from a mixture consisting of 76.5% of Alkaril ® SRP-2F (PET-POET copolymer of weight average molecular weight of about 30,000), 13.5% of Alkaril ® HNM-1223-15 (Silicone X, of Formula II (p. 22), wherein x = 160 and y = 3.8, mfd. by GAF Corp., and 10% of Alcosperse ® 149D (40% sodium polyacrylate of M.W. of about 2,000, and 60% water, mfd. by Alco Chemical Corp.)
++ Arosurf ® MCV8, mfd. by Sherex Chemical Corp.

A particulate antistatic soil release promoting softergent composition of the formula given is made in the manner detailed in the previous portion of this specification. Under A in the first column are given the weights of the three main parts of the composition, and the weights of components of such parts are given under B. The components of Part I, all of which are in powder form (and include $H_2O$), are mixed in an aqueous crutcher medium to form a 60% solids content mix, at a temperature of about 70° C., and such mix is spray dried in a countercurrent spray tower, with an inlet air temperature of about 400° C. into base beads which have a moisture content of about 6 to 12% and are of particle sizes in the range of numbers 10 to 100, U.S. Sieve Series. Excess fines and coarse particles are removed by sieving and/or classification operations, which are conducted after cooling of the particles to room temperature. Subsequently, the components of Part II are sprayed together as a melt onto the moving surfaces of the base beads, as the beads are mixed in a suitable mixing apparatus, which may be an inclined drum which is rotated axially, or a Lödige or O'Brien mixer. Although sequential applications of the three components of Part II may be practiced, it may often be preferable to mix together the nonionic detergent and silicone glycol copolymer at an elevated temperature, e.g., about 50° C., and apply the resulting mutual solution to the base beads by spraying finely divided droplets thereof onto moving surfaces of the beads, by which the solution or melt is absorbed. The perfume is then applied to the beads at room temperature. However, while it is considered to be preferred from a manufacturing standpoint to apply the nonionic detergent and SGC as a melt the same good antistatic action improvement is obtained when the SGC is applied as a blend with the MAPS, and such blend is added to detergent composition base (II+I) with the other Part III components.

The multi-action polymer particles (MAPS) of Part III are made by mixing the Alkaril SRP-2F PET-POET copolymer, Silicone X and the Alcosperse 149D, heating to 200° C., and holding at that temperature for about two hours, after which the melt resulting is cooled and is cryogenically ground to particle sizes in the range of No's. 10 to 100, U.S. Sieve Series. During such heating the water present in the Alcosperse 149D is evaporated, so the formula amount of sodium polyacrylate obtained from the 8.36% of the MAPS is 0.36% (0.53% being the proportion of water [formula basis] lost in the fusion operation). The multi-action polymer particles (MAPS), cationic fabric softening agent (Arosurf MCV8), fluorescent brightener and calcium silicate powder are all then admixed with the particulate detergent composition, resulting in a free flowing antistatic soil release promoting particulate softergent composition of this invention, in which the antistatic activity is substantially improved due to the presence of the combination of silicone glycol copolymer, hydrolyzable silicone, PET-POET copolymer and sodium polyacrylate. When the SGC is not a component of Part II, dissolved in the nonionic detergent or separate from it, but instead is a part of Part III, it is preferably mixed with the MAPS and such four-member composition is admixed with the detergent composition as a part of Part III, with the CFS. The final composition properties are essentially the same but flowability may be somewhat greater for the product of the process that was described earlier herein.

The particulate composition is then packed in individual water permeable pouches like those of FIGS. 1 and 2, which were described earlier in this specification, are described in U.S. patent application Ser. No. 07/098,347, and are used for the commercial product FAB-1-SHOT, marketed by Colgate-Palmolive Company. The charge is 44 g./pouch, and a single pouch is charged to 64–67 liters of wash water (about 0.07% concentration of the detergent composition).

The improvement in antistatic action of the invented composition is significant and unequivocal and is determined by comparisons of washed and dried test swatches with control swatches that were washed with a control composition (which did not contain MAPS, but which did contain more builder salt, more nonionic detergent and a lesser proportion of SRP-2F) and were then dried. The formula of the control composition follows: 71.82% of non-phosphate base beads, 18.02% of Neodol 25-7, 1.13% of 190 Silicone Surfactant, 0.40% of perfume, 6.76% of Arosurf MCV8, 1.08% of SRP-2F, 0.55% of BBH fluorescent brightener, and 0.25% of Microcel C. Thus, the only additional components of the invented composition are the Silicone X and the polyacrylate, and it contains more PET-POET copolymer. None of such three materials is an antistatic agent. The only component of either the invented or control compositions which is classifiable as an antistatic agent is the MCV8 (distearyl dimethyl ammonium chloride), and the control formula even includes slightly more of such compound.

The determination of antistatic activity of washed laundry was made by washing test swatches and "ballast" items in a washing machine for ten minutes, using a normal cycle setting, with the water temperature being 38° C. After washing, the test loads were dried in an automatic laundry dryer for one hour, with the ambient air being at a temperature of 21° C. and of a relative humidity of about 30%. The tub of the washing machine holds 64 liters of water, the water is of a hardness of about 150 p.p.m., as $CaCO_3$, and the charge of softergent composition to the wash water is one water permeable packet or pouch containing 44 g. of the composition being tested (or the control). The test items employed (four of each were present per wash load) included terrycloth hand towels, cotton percale, 65/35 polyester/cotton, nylon tricot, polyester single knit, polyester double knit, and acetate tricot swatches. Because most of today's laundry is increasingly being comprised of cotton, polyester/cotton blend and polyester fabrics, test results for swatches of such fabrics were considered to be most important. The ballast items employed included three face cloths, three cotton T-shirts, three polyester/cotton T-shirts, two polyester/cotton pillow cases, two polyester/cotton dress shirts, one polyester blouse, two placemats, three dish towels, two nylon half slips and two nylon/acrylic socks. The total weight of the laundry in the washing machine was about 3 kilograms.

The static charges on the test swatches were measured electronically and by human evaluators. For the electronic test a Model 255 Digital Star-Arc™ Electrostatic Field Meter, manufactured by Monroe Electronics Corp., was used. In a practical "observed static" rating test a panel of twenty members rated the washed and dried items and gave them numerical ratings according to the following observations:

1—no static, no detectable cling of any items;

2—very light static, very slight attraction between swatches when they are brought together but no readily observable cling and only slight static;

3—light, little static and little cling;

4—light/moderate—definite cling and static on ⅓ of the synthetics;

5—moderate—¼ of the items affected by cling and static, including ⅔ of the synthetics;

6—moderate/heavy—same as 5 but cling and static are more intense;

7—heavy—½ of items affected by clean and static, including all of the synthetics;

8—very heavy—same as 7 but cling and static are more intense;

9—severe—¾ or more of all items affected by cling and static, including all synthetics and some cotton items.

According to the rating system given above, after washing and drying, the experimental product received an average rating of 2 whereas the control was rated 4, which indicates a very significant difference in static and cling, with the experimental product being much more effective in inhibiting static charge development on the laundry. When the same test was performed on swatches washed with the experimental and control products after two weeks elevated temperature aging of the softergents (at 43° C.) the respective ratings were 1 and 5, indicating an even greater difference in antistatic activity. Using an electrostatic field meter, static readings were four kilovolts for the experimental (sometimes readings as low as 2 kv. have been obtained) and ten kilovolts for the control, without aging, and five kilovolts for the experimental and eight kilovolts for the control, after aging, verifying the antistatic action of the experimental product noted by the human test panel. For comparison, swatches washed with commercial heavy duty or built laundry detergent compositions (without CFS) normally give static readings in the range of 20 to 40 kv.

In fabric softness evaluation tests the experimental softergent packet article was superior to the control in softness of washed and dried fabrics, with such differences being even greater when the softergent compositions tested were both aged. In other tests of desirable characteristics of detergent compositions, the experimental was found to be superior to the control in detergency (stain removal) and in soil release promotion, and was found to be satisfactory for fluorescent brightening, perfume integrity, water absorbency, quaternary salt deposition and evacuation (from the pouch). The deposition of quaternary salt on the washed and dried laundry, as indicated by bromophenol blue dye tests, was very even from wash waters to which the experimental article had been added and such deposition improved after second and third washing/drying cycles. Compared to control tests which include washing with a commercial phosphate-built anionic detergent system, followed by drying in the presence of dryer sheets, the invented compositions gave much more uniform deposition of quaternary salt and left the washed and dried laundry feeling less "greasy", which is verifiable by tests that show better water absorption by laundry subjected to the invented washing process, compared to that by control laundry treated with dryer sheets (greasy laundry absorbs water poorly).

EXAMPLE 2

Compositions and articles like those of the experimental and control products of Example 1 are made, with the sole difference being in the builder for the base beads being a mixture of sodium tripolyphosphate and sodium silicate (of $Na_2O:SiO_2$ ratio=1:2.4). The weight percentages of the sodium tripolyphosphate and sodium silicate are 49.92 and 5.85, respectively, in the composition, and the weight of the base beads employed is 64.87% (including 9.1% of water). The experimental and control phosphate-silicate formulas are tested in the same manner as was previously described in Example 1 for the non-phosphate formulas, and the results obtained are substantially the same, with the invented (or experimental) phosphate-built product being better than or about equal to the control in all characteristics measured by the described tests. Specifically, with respect to static, the observed static numbers after one wash were essentially the same for the experimental and control formulas when such were unaged (with the control being slightly better), but after aging the difference was very significant, 4 for the control and 1 for the experimental. Similar results were obtained when static was measured by means of the static meter, with the kilovolt readies being 7.0 kv. for the control and 4.5 kv. for the experimental, after product agings. As in Example 1, both the experimental and control products were very much superior in static control to conventional commercial detergent compositions which did not contain any antistatic agent.

The phosphate-built compositions (and articles), whether controls or invented products, were slightly inferior to the non-phosphate products in fabric softening and were slightly superior in cleaning action at both 38° C. and 21° C. wash water temperatures, with greater differences in cleaning effects being apparent after agings of the materials tested, followed by washings at 38° C. Similarly, the phosphate formulas were superior for soil release at a washing temperature of 21° C., both initially and after aging, but the phosphate and non-phosphate products were essentially equivalent in soil release after washing in 49° C. wash water.

EXAMPLE 3

The experimental formulas of Examples 1 and 2 are made but the content of sodium polyacrylate (from the MAPS component) in the detergent composition is varied from 0 to 3%. With no polyacrylate present as much improvement in antistatic action of the MAPS and the "four-mender" composition on the present softergents was not obtained after aging at elevated temperature, and the presence of sufficient sodium polyacrylate in the MAPS resulted in the desired improved antistatic action. It has been found that at least 0.1% of sodium polyacrylate in the final detergent composition formula is desirable to obtain the mentioned antistatic effect, with preferred ranges being 0.2 or 0.3 to 0.7% (more polyacrylate may be employed, but is unnecessary).

The antistatic action of the present compositions can be increased by employing more cationic fabric softening and antistatic agent (CFS) but such is uneconomical and can result in inactivation of fluorescent brightener and the deposition of such cationic material on the surfaces of laundered fabrics to such an extent as to make them water repellent. That is considered to be disadvantageous (it interferes with desirable "breathing" of the laundered garments when they are being worn), so the present formulas, with lesser contents of such cationic compound, are preferred.

EXAMPLE 4

Instead of employing the described compositions in the water permeable pouches, as described in Examples 1 and 2, equivalent results are obtainable by employing the unpacketed compositions as washing agents. Such results are also obtainable by utilizing the described four-member composition (which includes MAPS and SGC) as a wash cycle additive for softergent compositions based on built nonionic detergent and quaternary ammonium fabric softening and antistatic compound (CFS) with the wash waters resulting after additions of the wash cycle additive compositions being of the same compositions as those of Examples 1 and 2, respectively. Such four-member compositions plus CFS may also be employed with anionic detergent compositions but the results are not as good, probably due to interactions of the anionic detergent with the CFS.

EXAMPLE 5

6.80 Parts of Alkaril SRP-2F and 1.20 parts of Alkasil HNM-1223-15 are mixed together and heated to a temperature of 200° C., at which they are held for about two hours, after which the mix is cooled to solid form and subsequently is cryogenically size-reduced so as to be of particle sizes in the range of No's. 10 to 100, U.S. Sieve Series. The particulate product obtained is useful directly or when compounded with other materials, including softergent composition components, to improve the antistatic activities of cationic fabric softening compositions, especially those based on quaternary ammonium halides.

8.00 Parts of particulate product of this example are blended with 6.67 parts of the CFS described in Examples 1 and 2 or such CFS is fused with the Silicone X and SRP in such proportions and subsequently such melt is cooled and size-reduced) and the resulting particulate composition(s) is/are employed as additive(s) for built nonionic detergents to convert them to antistatic softergents. The formula proportions (from Examples 1 and 2) of the SGC and/or polyacrylate are also incorporated with the mentioned 3-member compositions, and such 4- and 5-member compositions are utilized as additives to detergent compositions of the type previously described or are added directly to the wash water, in the proportions set forth in Examples 1 and 2, with respect to the other components of the detergent compositions and of the wash water, to improve the antistatic properties of laundry being washed, using the concentrations of the softergent compositions or their components, as previously given.

In another example of the invention the Silicone X-SRP product of this example, with and without polyacrylate and/or SGC type material, is dissolved in a suitable solvent, such as methylene chloride, or such 1–25% solution is applied to absorbent paper towelling material to the extent of 1 to 10% by weight of "solids" and the treated paper is added, in normal dryer sheet size, to laundry being dried in an automatic laundry dryer, to soften it and to make it antistatic. Alternatively, the 2-, 3-, 4- and 5-member compositions described, at a total concentration of 1 or 5 to 25%, in an aqueous medium in which they are emulsified and/or dispersed by means of conventional emulsifier and dispersing agents, such as polyethylene glycol esters of higher fatty acids and higher fatty alcohol ethylene oxide condensation products, are added to the wash water or the rinse water to produce concentrations thereof in such water of 0.01 to 0.1%, thereof, or in some cases, such are sprayed onto the laundry prior to drying or are sprayed onto parts of the dryer that contact the laundry during drying, so that they can be transferred to the laundry from them. In all such instances the application of the improved compositions, containing Silicone X type compound and SRP, improves the antistatic effects of the detergents that were used in the washing operation and, when softergent is included in the formula, in the proportions previously described, the laundry is softened and made antistatic.

EXAMPLE 6

A liquid state softergent was made by mixing together 16.7 parts of Neodol 25-7, 5 parts of a 95:5 particulate mixture of SRP (PET-POET copolymer of molecular weight of about 30,000) and Silicone X (of Formula II, wherein x=160 and y=3.8), 0.4% of Tinopal 5BM fluorescent brightener and the balance of water. It was employed at a concentration of 0.19% to wash test laundry swatches and ballast items, in an automatic washing machine, after which the swatches were rinsed in such machine, and dried in an automatic laundry dryer, as in Example 1. The washed laundry was rated to be of a softness of 10, on a scale of 1 to 10, with 10 being softest, and exhibited only light static, despite the absence of CFS. With CFS present, as at a percentage of about 5 to 10%, the antistatic effect will be further improved, to ratings of 1 and 2 (according to the static ratings previously given herein).

EXAMPLE 7

(Additional Variations of the Invention)

Other particulate nonionic and antistatic soil release promoting detergent and softergent compositions of this invention which comprise other components described in the specification are made and are employed as such particulate compositions or are filled into pouches, as in the foregoing examples, to produce articles which satisfactorily evacuate the pouches, when such are utilized, to clean and treat laundry to make it antistatic. Additionally, when the permeable pouches are replaced by pouches which are soluble or which open in the wash water, essentially the same results are obtained. Also, when, in addition to or at least in partial replacement of the nonionic detergent recited in the mentioned examples, there are employed other nonionic detergents, such as Neodol 23-6.5, Igepal® CO-630 and Pluronic® DF-68, or equivalents, and corresponding NRE nonionic detegents, such as those which were described in the specification, including Tergitol® 24-L-60-N, and the builders are varied, also as taught in the specification, similar desirable properties are the results. Similarly, when other cationic softening and antistatic compounds, including other quaternary ammonium compounds, e.g., cetyl trimethyl ammonium bromide, dimethyl ditallowalkyl ammonium chloride, and imidazolinium salts, e.g., 2-heptadecyl-1-methyl-1-[(2 -stearoylamido)ethyl]-imidazolinium methyl sulfate, are employed, such results are obtained. When the SGC is replaced by other suitable silicone polymers, such as Silvet™L-7001 (Union Carbide Corp.) Magnasoft Ultra® Ucarsil™ T-29 and Ucarsil TE-24 (Union Carbide Corp.), or by mixtures of such components, good detergency, softening and antistatic action result. When other effective Silicone X type polymers are employed as components of the MAPS, such as those of Formula II wherein x=160 and y=2 or x=160 and y=8, and others within Formula I, such results are obtainable. Similarly, when PET-POET copolymers and polyacrylates of other molecular weights, such as within the ranges previously given, are employed the resulting compositions are also desirably operative. When the various adjuvants present in the compositions of the examples are changed, with some or all being omitted (except that some moisture is normally present) good results are also obtained.

In addition to the substitutions of other described components for those of the preceding examples the proportions of components, as given in the examples, may be varied, for example, ±10%, and ±25%, providing that such proportions are kept within the ranges recited in this specification, and good products will result.

Instead of employing a non-woven polyester fabric pouch, such pouches may be made of other materials, including mixed polyester-cotton, e.g., 50:50 polyester:cotton, rayon, nylon, blends of such synthetics and blends thereof with natural fibers, such as blends with cotton. The fabrics may be woven or non-woven and the fibers may be of different deniers (although preferably they will be of about the same denier), weights and permeabilities, providing that such allow the satisfactory evacuation of the composition from the pouch (or other permeable container) during automatic washing machine washing of laundry, but normally the denier, weight of fabric and its permeability will be within preferred ranges, as given in the specification.

In the washing of laundry with compositions or articles of this invention improved fabric softening and antistatic action are obtained, which is especially important for laundry items of synthetic fabrics, such as polyesters and cotton/polyester blends. When the invented articles are employed the consumer is always assured of having the right amount of detergent composition in the wash water for a normal wash load, and pouring and measuring of detergent powder are avoided. The wash water hardness will normally be less than 300 p.p.m., as $CaCO_3$, but harder waters can be used. Washing temperature will often be cool and frequently may be less than 70° C., but higher temperatures are operative and sometimes the use of higher temperature wash waters can be more desirable, because heat promotes the solubilizing of the contained composition, thereby aiding in transporting it through permeable container walls, and also promotes better cleaning. The wash laundry will usually contain synthetic fabrics or mixed synthetic-natural fabrics but the invention is also operative with laundry made only of natural fibrous material, e.g., cottons. After washing in the washing machine (which is normally automatic) the laundry is usually machine dried, and when drying is in an automatic laundry dryer the improved antistatic actions of the invented compositions are most significant.

Where, in the above description molecular weights and/or carbon atom contents of compounds were given they apply to average, as well as to actual molecular weights and contents.

The invention has been described with respect to illustrations and working embodiments thereof but it is not to be considered as limited to these because it is evident that one of skill in the art will be able to utilize substitutes and equivalents without departing from the invention.

What is claimed is:

1. An antistatic and soil release promoting, softener composition which, when added to a nonionic detergent composition or to wash water containing such a detergent composition or its components, significantly improves the antistatic action and softening properties on washed laundry of the detergent composition or the wash water, which comprises 20 to 200 parts by weight of a cationic fabric softener (CFS); 2 to 30 parts by weight of an antistatic silicone polymer (Silicone X) of the formula:

$$ZO-\left[\begin{array}{c}R^2\\-SiO-\\R^3\end{array}\right]_x\left[\begin{array}{c}R^4\\-SiO-\\H\end{array}\right]_p\left[\begin{array}{c}R^5\\-SiO-\\Z^1\end{array}\right]_y-Z^2$$

wherein $R^2$ and $R^3$ are each independently alkyl or aryl, which may be substituted with lower alkyl; $R^4$ is hydrogen or $R^2$; $Z^1$ is $—CH_2CHA—(CH_2)_rSi(R^1)_3$; Z and $Z^2$ are each independently $(R^6)_nSiH_{(3-n)}$ or $—CH_2CHA—(CH_2)_rSi(R^1)_3$; n is 0 to 3; $R^6$ is alkyl, alkoxy, phenoxy or aryl, which may be substituted with lower alkyl; $R^5$ is $R^2$ or $Z^1$; x is 2 to 1000; y is 1 to 200; p is 0 to about 50% of y; A is hydrogen, alkyl or phenyl; r is 0 to 12; and $R^1$ is hydroxy, acyloxy, halogen, amino, alkoxy, aryloxy or aryloxy substituted with lower alkyl, halogen or acyloxy; and 40 to 95 parts by weight of a soil release promoting polyethylene terephthalate-polyoxyethylene terephthalate copolymer (PET-POET).

2. A composition according to claim 1 wherein the cationic fabric softener is a quaternary ammonium salt, in the formula of the silicone polymer Z1 and Z2 are each independently (R6)nSiH(3–n) wherein R6 is alkyl of 1 to 18 carbon atoms, n is 3, p is 0, R2, R3 and R5 are independently methyl or ethyl, Z1 is —CH2CHA—(CH2)rSi(R1)3, wherein A is hydrogen, r is 0 to 6, and R1 is lower alkoxy of 1 to 4 carbon atoms, x is in the range of 20 to 200 and y is in the range of 1 to 15; the polyethylene terephthalate and polyoxyethylene terephthalate copolymer is of a molecular weight in the range of 15,000 to 50,000; the composition is in particulate form, and said silicone polymer and PET-POET are present as particles made by fusion, cooling and size reduction of a melt of said components.

3. A composition according to claim 2 wherein said cationic fabric softener is included in said melt.

4. A composition according to claim 2 which includes, in addition, 1 to 8 parts by weight of a low molecular weight polyacrylate, said polyacrylate being present in said melt.

5. A composition according to claim 2 wherein said cationic fabric softener is included in said melt.

6. A composition according to claim 2 which includes, in addition, 2 to 30 parts by weight of a silicone glycol copolymer.

7. A composition according to claim 5 which includes, in addition, 2 to 30 parts by weight of a silicone glycol copolymer.

8. A composition according to claim 6 in which the quaternary ammonium salt is of the formula

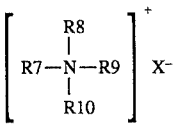

wherein R7 and R8 are lower alkyls of 1 to 3 carbon atoms, R9 is higher alkyl of 10 to 20 carbon atoms, R10 is alkyl of 1 to 20 carbon atoms, and X is halogen; in the formula of the silicone polymer R1 is methoxy, R2, R3 and R5 are each methyl, r is 0, x is in the range of 30 to 170 and y is in the range of 1 to 10; the molecular weight of the polyethylene terephthalate-polyoxyethylene terephthalate copolymer is in the range of 20,000 to 40,000; the polyacrylate is sodium polyacrylate of a molecular weight in the range of 1,000 to 10,000; and the silicone glycol copolymer is of the formula

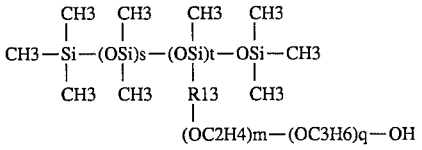

wherein R13 is a hydrocarbyl radical of 1 to 10 carbon atoms, s is in the range of 6 to 420, t is in the range of 3 to 30, and m+q=25 to 100, with the molar proportion of ethoxy groups to propoxy groups being in the range of 1:4 to 7:3.

9. A composition according to claim 7 in which the quaternary ammonium salt is of the formula

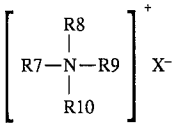

wherein R7 and R8 are lower alkyls of 1 to 3 carbon atoms, R9 is higher alkyl of 10 to 20 carbon atoms, R10 is alkyl of 1 to 20 carbon atoms, and X is halogen; in the formula of the silicone polymer R1 is methoxy, R2, R3 and R5 are each methyl, r is 0, x is in the range of 30 to 170 and y is in the range of 1 to 10; the molecular weight of the polyethylene terephthalate-polyoxyethylene terephthalate copolymer is in the range of 20,000 to 40,000; the polyacrylate is sodium polyacrylate of a molecular weight in the range of 1,000 to 10,000; and the silicone glycol copolymer is of the formula

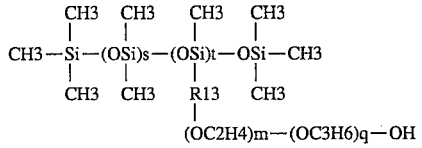

wherein R13 is a hydrocarbyl radical of 1 to 10 carbon atoms, s is in the range of 6 to 420, t is in the range of 3 to 30, and m+q=25 to 100, with the molar proportion of ethoxy groups to propoxy groups being in the range of 1:4 to 7:3.

10. A detergent composition of improved fabric softening, soil release promoting and antistatic properties, so that laundry washed with it will be softer, cleaner and of decreased tendency to accumulate static charges, which comprises a detersive proportion of nonionic detergent, a building proportion of builder for the nonionic detergent and a fabric softening, soil release promoting and anti-static proportion of a composition of claim 1.

11. A detergent composition of improved fabric softening, soil release promoting and antistatic properties, so that laundry washed with it will be softer, cleaner and of decreased tendency to accumulate static charges, which comprises a detersive propertion of nonionic detergent, a building proportion of builder for the nonionic detergent and a fabric softening, soil release promoting and anti-static proportion of the composition of claim 4.

12. A detergent composition according to claim 11, in particulate form, which comprises, by weight, 8 to 30% of nonionic detergent; 30 to 70% of builder for such nonionic detergent; 0.5 to 10% of cationic fabric softener 0.1 to 2% of an antistatic silicone polymer of the formula:

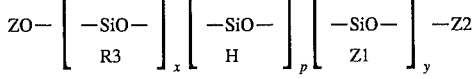

wherein R2 and R3 are each independently alkyl or aryl, which may be substituted with lower alkyl; R4 is hydrogen or R2; Z1 is —CH2CHA—(CH2)rSi(R1)3; Z and Z2 are each independently (R6)nSiH(3–n) or —CH2CHA—(CH2)rSi(R 1)3; n is 0 to 3; R6 is alkyl, alkoxy, phenoxy or aryl, which may be substituted with lower alkyl; R5 is R2 or Z1; x is 2 to 1000; y is 1 to 200; p is 0 to about 50% of y; A is hydrogen, alkyl or phenyl; r is 0 to 12; and R1 is hydroxy, acyloxy, halogen, amino, alkoxy, aryloxy or aryloxy substituted with lower alkyl, halogen or acyloxy; and 1 to 10% of a soil release promoting polyethylene terephthalate-polyoxyethylene terephthalate copolymer (PET-POET) and 0.2 to 0.7% of said polyacrylate.

13. A detergent composition according to claim 12 wherein the nonionic detergent is a condensation product of a higher fatty alcohol and ethylene oxide; the cationic fabric softener is a quaternary ammonium halide; the antistatic silicone polymer is one wherein R1 is methoxy, R2, R3, R5 and R6 are each methyl, r is 0, x is about 30 to 170, y is about 1 to 10, n is 3, p is 0, Z1 is —CH2CHA—(CH2)rSi(R1)3, wherein A is hydrogen; the polyethylene terephthalate-polyoxyethylene terephthalate copolymer copolymer is of a weight average molecular weight in the range of 15,000 to 50,000; and said polyacrylate is sodium polyacrylate.

14. A detergent composition according to claim 13 which comprises, by weight, 12 to 25% of the nonionic detergent, 35 to 65% of sodium tripolyphosphate, 2 to 10% of sodium silicate, 1 to 6% of cationic fabric softener, 1.0 to 1.5% of the silicone polymer, 0.3 to 0.7% of sodium polyacrylate, 6.5 to 8% of polyethylene terephthalate-polyoxyethylene terephthalate copolymer, and includes, in addition, 0.7 to 1.3% by weight of silicone glycol copolymer.

15. A detergent composition according to claim 13 which comprises, by weight, 12 to 25% of nonionic detergent, 15 to 35% of sodium carbonate, 5 to 20% of sodium bicarbonate, 10 to 35% of hydrated zeolite, 1 to 6% of cationic fabric softener, 0.5 to 1.5% of silicone polymer, 0.3 to 0.7% of sodium polyacrylate, 1 to 10% of polyethylene terephthalate-polyoxyethylene terephthalate and includes, in addition, 0.1 to 2% of silicone glycol copolymer.

16. A detergent composition of improved fabric softening, soil release promoting and antistatic properties, so that laundry washed with it will be softer, cleaner and of a decreased tendency to accumulate static charges, which comprises a detersive proportion of nonionic detergent and a soil release promoting, fabric softening and antistatic proportion of particles of a mixture of 40 to 95 parts by weight of PET-POET, 2 to 30 parts by weight of Silicone X polymer of claim 1 and 1 to 8 parts by weight of a sodium salt of a low molecular weight polyacrylate which are formed by size reducing a cooled melt of said mixture to a particle size that will pass through a No. 10 sieve, U.S. Sieve Series.

17. An antistatic and soil release promoting article which comprises a composition of claim 11 in a permeable pouch, through walls of which it is transported to wash water during washing of laundry.

18. A process for manufacturing a composition according to claim 1 which comprises heating a mixture of at least the antistatic silicone polymer and the polyethylene terephthalate-polyoxyethylene terephthalate copolymer at an elevated temperature in the range of 150° C. to 200° C. to form a melt, cooling said melt to solidification and size reducing the solid to a particle size that will pass through a No. 10 sieve, U.S. Sieve Series and admixing said particles with said cationic fabric softener.

19. A process according to claim 18 wherein the resultant particles are blended with particulate cationic fabric softener, with the product resulting being of particle sizes in the No's 10 to 100 range, U.S. Sieve Series.

20. A process according to claim 18 wherein said melt includes, in addition, 1 to 8 parts by weight of a sodium salt of a low molecular weight polyacrylate.

21. A process for washing laundry and at the same time treating it with soil release promoting and fabric softening and antistatic materials which comprises washing the laundry in wash water containing a softergent composition according to claim 10.

22. A process for washing laundry and at the same time treating it with soil release promoting and fabric softening and antistatic materials which comprises washing the laundry in wash water containing a detergent composition according to claim 11.

23. A process for washing laundry and at the same time treating it with soil release promoting and fabric softening and antistatic materials, which comprises washing the laundry in water containing a detergent composition according to claim 16.

* * * * *